United States Patent [19]

Skuby

[11] Patent Number: 4,741,983

[45] Date of Patent: May 3, 1988

[54] DUAL DYE SENSITIZED ELECTROPHOTOGRAPHIC ZINC OXIDE

[75] Inventor: Leonard Skuby, Mundelein, Ill.

[73] Assignee: AM International, Inc., Chicago, Ill.

[21] Appl. No.: 7,870

[22] Filed: Jan. 28, 1987

Related U.S. Application Data

[63] Continuation-in-part of Ser. No. 837,634, Mar. 10, 1986, abandoned.

[51] Int. Cl.[4] ..... G03G 5/087; G03G 5/09

[52] U.S. Cl. ..... 430/93; 430/91

[58] Field of Search ..... 430/83, 95, 91, 92, 430/93

[56] References Cited

U.S. PATENT DOCUMENTS

| | | | |
|---|---|---|---|
| 4,362,800 | 12/1982 | Takimoto et al. | 430/93 X |
| 4,418,135 | 11/1983 | Beeson et al. | 430/93 |

FOREIGN PATENT DOCUMENTS

| | | | |
|---|---|---|---|
| 2902705 | 7/1979 | Fed. Rep. of Germany | 430/91 |
| 58-42055 | 3/1983 | Japan | 430/93 |
| 60-185955 | 9/1985 | Japan | 430/91 |

*Primary Examiner*—Roland E. Martin

*Attorney, Agent, or Firm*—Nicholas A. Camasto; James P. Zeller

[57] ABSTRACT

A photoconductive composition useful in electrophotography comprising a mixture of photoconductive zinc oxide, a binder, a first dye which absorbs near infrared radiation and which is effective in sensitizing the zinc oxide to near infrared radiation, and a second dye which absorbs visible radiation, sensitizes zinc oxide to such visible radiation and is effective in enhancing the discharge rate of the sensitized zinc oxide at any given intensity of the near infrared radiation is provided. A paper base sheet coated with such a photoconductive composition can be used in the preparation of an electrophotographic image.

28 Claims, No Drawings

DUAL DYE SENSITIZED ELECTROPHOTOGRAPHIC ZINC OXIDE

CROSS-REFERENCE TO RELATED APPLICATION

This is a continuation-in-part of copending, commonly assigned application Ser. No. 837,634 filed Mar. 10, 1986 in the name of Leonard Skuby and entitled "Electrophotography", now abandoned.

BACKGROUND OF THE INVENTION

1. Field of the Invention

This invention relates generally to electrophotography and, more particularly, this invention relates to printing element compositions and methods.

2. Description of Related Art

Electrophotography is an imaging process that typically involves the formation of an electrostatic image on a somewhat electrically conductive, solvent impervious photoconductive medium. It is known that zinc oxide can be employed in making photoconductive layers on a paper substrate and that photographic copies can be prepared from papers coated with such photoconductive compositions.

Generally, electrophotographic paper is prepared by applying a coating comprising a mixture of zinc oxide and a suitable binder to a conductive paper substrate. Prior to exposure to light, the zinc oxide layer is given a negative electrostatic charge by means of ion transfer from a corona discharge. When the charged paper is exposed to an optical image, electrical conductivity is produced in the areas where light strikes the coating, and the charge dissipates through the conductive sheet. The print area not exposed to light retains a latent image in the form of an electrostatic charge. The exposed coating is developed by attracting toner (positively charged pigment particles dispersed in a low melting-point resin) to the negatively charged print areas. If a solid toner is used, heat may be used to fuse the toner to the zinc oxide coating. If a liquid toner is used, heat is not required to fuse the toner to the zinc oxide but may be used to evaporate the solvent.

The above described process for the preparation of a print may be used for the preparation of an offset print or offset master for use in offset printing wherein the "master" serves as an intermediate in the process of making an image from an original. In offset printing, the master is contacted with a conversion solution which makes the background, i.e. the zinc oxide, hydrophilic while the imaged areas remain hydrophobic. The offset rollers then apply ink and water to the converted master. Ink is transferred to an offset cylinder, commonly referred to as a "rubber blanket". The ink is subsequently transferred from the blanket to paper, thereby effecting the offset printing of the image.

Unsensitized zinc oxide normally has a spectral . response in the ultraviolet region of the spectrum, at about 386 nanometers (nm). Photoconductive layers consisting of unsensitized zinc oxide are slow to respond to light and therefore require considerable exposure time to form latent electrostatic images. To obviate these problems, those in the art have sought to sensitize the photoconductive materials, such as the zrnc oxide used in photoconductive coatings, by the addition of sensitizing dyestuffs which are capable of absorbing the radiant energy of the wavelengths to which the photoconductive material is otherwise substantially insensitive and which are further capable of transferring the absorbed energy to the photoconductive material. For an electrophotographic process, zinc oxide is generally sensitized to be responsive in the visible region of the spectrum at a wavelength between about 500–620 nanometers, by the addition of low concentrations of sensitizing dyes.

Cyanine dyes are among the dyes that have been found to be most useful for spectral sensitization of zinc oxide. Cyanine dye sensitization has been disclosed in U.S. Pat. No. 3,619,154 (Nov. 9, 1971) to G. A. Cavagna et al. Zinc oxide electrophotographic coatings containing cyanine sensitizers and multi-component binders are disclosed in U.S. Pat. No. 3,682,630 (Aug. 8, 1972) to W. C. Park et al.

Offset masters are commonly made by exposure of a photosensitive sheet to visible light. The use of lasers for the making of masters, however, allows master radiation input information to be easily translated to a digital form. Digital input facilitates and permits the efficient use of computers for the storage of such master input information.

The electrical properties of zinc oxide coatings that affect print quality include charge acceptance, dark decay rate, light decay rate, and residual voltage. Coatings with high charge acceptance attract more toner and consequently produce denser prints. A fast light decay rate and a low residual voltage combine to increase the speed of photoresponse and give clean prints, free of background. Higher production rates can be achieved through the use of coatings which have a comparatively high speed of photoresponse. Dark decay rate is important if it is excessively high. Print density is a function of the voltage on the coating at the time it passes through the toner and the coatings that have lost a large portion of the original charge because of a high dark decay rate have poor print density regardless of initial charge acceptance voltage.

SUMMARY OF THE INVENTION

It is an object of the invention to overcome one or more of the problems described above.

According to the present invention, a mixture of photoconductive zinc oxide, a binder, a first dye which absorbs near infrared radiation and which is effective in sensitizing the zinc oxide to near infrared radiation, and a second dye which absorbs visible radiation and is effective in sensitizing zinc oxide to visible radiation, and is effective in enhancing the discharge rate of the sensitized zinc oxide at any given intensity of near infrared radiation is provided.

In addition, the invention comprehends on a electrophotographic printing element and a method for preparing an image therewith.

Other objects and advantages will be apparent to those skilled in the art in the following detailed description taken in conjunction with the appended claims.

DETAILED DESCRIPTION OF THE INVENTION

According to the invention, a photoconductive composition of a mixture of photoconductive zinc oxide, a binder, and first and second dyes is provided. The first dye absorbs near infrared radiation and is effective in sensitizing the zinc oxide to near infrared radiation. The second dye is capable of absorbing visible radiation and sensitizing the zinc oxide to such visible radiation, and is effective in enhancing the discharge rate of the sensitized zinc oxide at any given intensity of the near infrared radiation. (As used herein the term "visible radiation" is synonymous with "visible light", e.g. electromagnetic radiation having a wavelength of about 500–620 nm.)

Compositions of the invention may use zinc oxide powder that is commercially available for electrophotographic applications. A typical photoconductive zinc oxide, useful in the practice of the present invention, is St. Joe No. 321 PC (available from St. Joe Minerals Corporation, Monaca, Pa.).

The composition of the invention also includes a binder effective in affixing or holding the zinc oxide to a paper substrate. While any of the common binders effective for this purpose are useable herein, the electrophotographic acrylic resin binder designated E-338 (sold by DeSoto, Inc. of Des Plaines, Ill.) is a preferred binder for use in the practice of the present invention. The binder designated RP-2067 (sold by Monsanto Co. of St. Louis, Mo.), is an example of an alternative binder that may be used herein.

The photoconductive composition of the invention is typically prepared by mixing photoconductive zinc oxide and the binder in an effective solvent. Toluene, an aromatic solvent, is a preferred solvent for use in the practice of the invention.

In addition, various coating modifiers may be added to the coating composition solution. For example, it has been found useful to include a minor proportion of the anionic anti-floating, wetting and suspending agent known as Lactimon TM (sold by Byk-Mallinckrodt, Melville, N.Y.). The composition of Lactimon TM wetting and suspending agent is based on an acid salt of long chain amines with a polycarboxylic acid and combined with a paint-compatible silicone resin and its inclusion and use in the composition is helpful in preventing the cracking of a coating prepared from the composition after it has been dried.

The solution is subjected to high speed shear mixing so as to effect substantially complete and uniform dispersal of the zinc oxide in the solution. Subsequently, the two dyes are added and mixed into the solution.

The first dye absorbs near infrared radiation such as that having a wavelength in the range about 780–820 nm and is effective in sensitizing the zinc oxide to near infrared radiation. It has been found that the dyes 1,1′, 3,3,3′,3′-hexamethyl-4,4′,5,5′-dibenzo-2,2′-indotricarbocyanine perchlorate and 3,3′-diethylthiatricarbocyanine perchlorate are effective in the practice of the present invention.

The second dye is generally of the type which is effective in absorbing visible radiation in sensitizing zinc oxide to such visible radiation. Such dyes are well known and include, without limitation, Methylene Blue, Rose Bengal, Eosin Y, Fluorescein, Alpha Zurine 2G, Alizarine Green, Acridine Orange, Bromophenol Blue and Phloxine B. The second dye of the invention is selected from dyes of the foregoing general type which are effective in enhancing the discharge rate of the sensitized zinc oxide at any given intensity of the near infrared radiation. The dyes Bromophenol Blue and Phloxine B, for example, have been found useful in the practice of the invention.

The coating composition so prepared may then be used in preparing an electrophotographic printing element by applying the photoconductive composition to a paper base sheet. The use of conductive paper as the paper substrate of the electrophotographic printing element is highly preferred, as is well known in the art. The resin binder serves to affix the zinc oxide to the paper substrate. The coated paper substrate is then passed to a drying means, such as a drying oven. Therein, the coating is dried on the substrate, thereby completing the production of a photosensitive printing element.

The above prepared photosensitive sheet may then be used in the preparation of an electrophotographic image. First, the electrophotographic printing element is electrically charged. Thereafter, the charged electrophotographic printing element is exposed to near infrared radiation, effecting a charge dissipation of the element. The sheet is then toned with an electrostatic toner, as is well known in the art, to produce a toned image.

Those skilled in the art may readily identify useful second dyes from the general class of visible light-absorbing, zinc oxide sensitizing dyes by simple preparation of a sample printing element as described above using a first dye and a candidate second dye followed by charging of the element and exposure of the charged element to near infrared radiation in order to dissipate the charge. The rate of discharge is compared to the rate of discharge of a substantially identical sample lacking the candidate second dye to determine whether the rate of discharge is increased by the presence of the candidate second dye.

A preferred embodiment of the coating composition of the invention may be prepared by mixing 500 grams of St. Joe - 321 zinc oxide, 140 grams of DeSoto, Inc. acrylic resin binder E-338, 2.3 grams of Lactimon TM wetting and suspending agent and 650 grams of toluene. The resulting mixture is then subjected to high speed shear so as to disperse the zinc oxide uniformly throughout the solution.

The dyes are then added to the zinc oxide/binder solution. The first dye comprises a 1% solution in methylethylketone (MEK) of the dye designated Kodak Chemical No. 15073 and having the chemical formula 1,1′, 3,3,3′,3′-hexamethyl-4,4′, 5,5′-dibenzo-2,2′-indotricarbocyanine perchlorate. Thereafter, a second dye comprising a 2% solution of Phloxine B in methanol is added. The solution is then mixed well and is subsequently applied to and dried on a paper substrate.

The respective concentrations of the components of the above described mixture, may be varied plus or minus about 10% and yet result in an effective coating composition. It is to be understood that the concentrations and relative proportions of the various components are readily empirically determinable by one of ordinary skill in the art, guided by the present disclosure.

The following examples illustrate the practice of the present invention. It is understood that all changes and modifications that come within the spirit of the invention is not to be construed as limited by these examples.

Using a simple K-D mixer, the coating compositions A-E shown in Table I were prepared:

TABLE I

| INGREDIENT | COMPOSITION A | B | C | D | E |
|---|---|---|---|---|---|
| 1. Toluene (g) | 696.0 | 650.0 | 650.0 | 650.0 | 650.0 |
| 2. Lactimon TM wetting and suspending agent (g) | 2.27 | 2.27 | 2.27 | 2.27 | 2.27 |

TABLE I-continued

| INGREDIENT | COMPOSITION A | B | C | D | E |
|---|---|---|---|---|---|
| 3. E-338 resin binder (g) | 19.0 | 19.0 | 19.0 | 19.0 | 19.0 |
| 4. ZnO (g) (St. Joe Grade 345) | 500.0 | 500.0 | 500.0 | 500.0 | 500.0 |
| 5. Methanol (cc) | 67.7 | | | | |
| 6. E-338 resin binder (g) | 120.0 | 120.0 | 120.0 | 120.0 | 120.0 |
| 7. Bromophenol Blue (g) (1% sol. in MeOH) | | | 16.0 | 16.0 | |
| 8. Dye Kodak Chemical No. 15073 (g) (1% sol. in MEK) | | 100.0 | 100.0 | | 25.0 |
| 9. Phloxine B (g) (2% sol. in MeOH) | | | | | 50.0 |

In composition A, no sensitizing dyestuff was present.

In composition B, 100 grams of a 1% solution in methylethylketone of the dye designated Kodak Chemical No. 15073 were present.

In composition C, 16 grams of the sensitizing dye Bromophenol Blue were added to the composition of example B.

In composition D, composition C was prepared without the presence of the first dye designated as Kodak Chemical No. 15073.

In composition E, the coating composition included 25 grams of the dye designated as Kodak Chemical No. 15073 and 50 grams of a 2% solution of Phloxine B in methyl alcohol.

Paper base sheets were coated with each composition and evaluated as follows. Each coated sheet was charged by means of a corona discharge and then exposed to a monochromatic light source (Bausch & Lomb Monochromator, 780 nm) five seconds after charging. The time required for the sheet to discharge to 50V was measured. Results are given below:

TABLE II

| COMPOSITION | ASV[1] | DISCHARGE TIME | ENERGY INPUT REQUIRED TO SENSITIZE |
|---|---|---|---|
| A | Unsensitized | No light decay observed | No sensitization |
| B | 405 V | 6.2 sec. | 3.35 uJ/cm$^2$ |
| C | 385 V | 2.85 sec. | 1.54 uJ/cm$^2$ |
| D | 335 V | No discharge | No sensitization |
| E | 455 V | 2.75 sec. | 1.48 uJ/cm$^2$ |

[1]Applied surface voltage

The foregoing demonstrates that the presence of Bromophenol Blue (Composition C) or Phloxine B (Composition E) as a second dye in a ZnO/sensitizing dye system according to the invention significantly increases the rate of discharge of a sensitized printing element at any given light intensity. Also, the required energy input is within the desirable range of 1–2 uJ/cm$^2$; with a sensitizing laser dye only, the required energy input is greater than 3 uJ/cm$^2$.

The foregoing detailed description is given for clearness of understanding only and, no unnecessary limitation should be understood therefrom, as modifications within the scope of the invention will be obvious to those skilled in the art.

I claim:

1. A photoconductive composition comprising a mixture of:

(a) photoconductive zinc oxide;

(b) a binder;

(c) an effective concentration of a first dye which absorbs near infrared radiation and which is effective in sensitizing said zinc oxide to near infrared radiation; and (d) an effective concentration of a second dye selected from the group consisting of Bromophenol Blue and Phloxine B which absorbs visible radiation, which sensitizes said zinc oxide to said visible radiation and which is effective in enhancing the discharge rate of said sensitized zinc oxide of (c) at any given intensity of said near infrared radiation.

2. The composition of claim 1 wherein said near infrared radiation comprises electromagnetic radiation having a wavelength in the range of about 780–820 nm and said visible radiation comprises electromagnetic radiation having a wavelength in the range of about 500–620 nm.

3. The composition of claim 1 wherein said first dye is selected from the group consisting of 1,1',3,3,3',3'-hexamethyl-4,4',5,5'-dibenzo-2,2'-indotricarbocyanine perchlorate and 3,3'-diethylthiatricarbocyanine perchlorate.

4. The composition of claim 1 additionally comprising a modifier effective in preventing cracking of said composition upon drying.

5. The composition of claim 1 wherein said binder comprises an acrylic resin.

6. A photoconductive composition comprising a mixture of:

photoconductive zinc oxide;

a binder;

a first dye which absorbs electromagnetic radiation having a wavelength in the range of about 780–820 nm and being in a concentration effective to sensitize said zinc oxide to said electromagnetic radiation, said first dye being selected from the group consisting of 1,1',3,3,3',3'-hexamethyl-4,4',5,5'-dibenzo-2,2'-indotricarbocyanine perchlorate and 3,3'-diethylthiatricarbocyanine perchlorate; and, a second dye in a concentration effective to enhance the discharge rate of said sensitized zinc oxide at any given intensity of said radiation, said second dye being selected from the group consisting of Bromophenol Blue and Phloxine B.

7. The composition of claim 6 additionally comprising a modifier effective in preventing cracking of said composition upon drying.

8. The composition of claim 6 wherein said binder comprises an acrylic resin.

9. An electrophotographic printing element comprising:

a paper base sheet and a coating on said sheet, said coating comprising a photoconductive composition including a mixture of (a) photoconductive zinc oxide, (b) a binder, (c) an effective concentration of a first dye which absorbs near infrared radiation and which is effective in sensitizing said zinc oxide to near infrared radiation, and (d) an effective concentration of a second dye selected from the group consisting of Bromophenol Blue and Phloxine B which absorbs visible radiation, which sensitizes said zinc oxide to said visible radiation and which is effective in enhancing the discharge rate of said sensitized zinc oxide of (c) at any given intensity of said near infrared radiation.

10. The printing element of claim 9 wherein said near infrared radiation comprises electromagnetic radiation having a wavelength in the range of about 780–820 nm and said visible radiation comprises electromagnetic radiation having a wavelength in the range of about 500–620 nm.

11. The printing element of claim 9 wherein said first dye is selected from the group consisting of 1,1',3,3,3',3'-hexamethyl-4,4',5,5'-dibenzo-2,2'-indotricarbocyanine perchlorate and 3,3'-diethylthiatricarbocyanine perchlorate.

12. The printing element of claim 9 additionally comprising a modifier effective in preventing cracking of said composition upon drying.

13. The printing element of claim 9 wherein said binder comprises an acrylic resin.

14. The printing element of claim 9 wherein said paper base sheet comprises conductive paper.

15. An electrophotographic printing element comprising:

a paper base sheet and a coating on said base sheet, said coating comprising a photoconductive composition including a mixture of photoconductive zinc oxide, a binder, a first dye which absorbs electromagnetic radiation having a wavelength in the range of about 780–820 nm and being in a concentration effective to sensitize said zinc oxide to said electromagnetic radiation, said first dye being selected from the group consisting of 1,1',3,3,3',3'-hexamethyl-4,4',5,5'-dibenzo-2,2'-indotricarbocyanine perchlorate and 3,3'-diethylthiatricarbocyanine perchlorate and a second dye in a concentration effective to enhance the discharge rate of said sensitized zinc oxide at any given intensity of said radiation, said second dye being selected from the group consisting of Bromophenol Blue and Phloxine B.

16. The printing element of claim 15 additionally comprising a modifier effective in preventing cracking of said composition upon drying.

17. The printing element of claim 15 wherein said binder comprises an acrylic resin.

18. The printing element of claim 15 wherein said paper base sheet comprises conductive paper.

19. A method of preparing an electrophotographic image on a photosensitive sheet comprising the sequential steps of:

electrically charging an electrophotographic printing element comprising a coated paper base sheet, said coating comprising a mixture of (a) photoconductive zinc oxide, (b) a binder, (c) an effective concentration of a first dye which absorbs near infrared radiation and which is effective in sensitizing said zinc oxide to near infrared radiation, and (d) an effective concentration of a second dye selected from the group consisting of Bromophenol Blue and Phloxine B which absorbs visible radiation, which sensitizes said zinc oxide to said visible radiation and which is effective in enhancing the discharge rate of said sensitized zinc oxide of (c) at any given intensity of said near infrared radiation;

imagewise exposing said charged electrophotographic printing element to near infrared radiation effecting charge dissipation of said element; and toning the sheet with an electrostatic toner to produce a toned image.

20. The method of claim 19 wherein said near infrared radiation comprises electromagnetic radiation having a wavelength in the range of about 780–820 nm and said visible radiation comprises electromagnetic radiation having a wavelength in the range of about 500–620 nm.

21. The method of claim 19 wherein said first dye is selected from the group consisting of 1,1'-3,3,3',3'-hexamethyl-4,4',5,5'-dibenzo-2,2'-indotricarbocyanine perchlorate and 3,3'-diethylthiatricarbocyanine perchlorate.

22. The method of claim 19 additionally comprising a modifier effective in preventing cracking of said composition upon drying.

23. The method of claim 19 wherein said binder comprises an acrylic resin.

24. The method of claim 19 wherein said paper base sheet comprises conductive paper.

25. A method of preparing an electrophotographic image on a photosensitive sheet comprising the sequential steps of:

electrically charging an electrophotographic printing element comprising a coated paper base sheet, said coating comprising a mixture of photoconductive zinc oxide, a binder, a first dye which absorbs electromagnetic radiation having a wavelength in the range of about 780–820 nm and being in a concentration effective to sensitize said zinc oxide to said electromagnetic radiation, said first dye being selected from the group consisting of 1,1',3,3,3',3'-hexamethyl-4,4',5,5'-dibenzo-2,2'-indotricarbocyanine perchlorate and 3,3'-diethylthiatricarbocyanine perchlorate and a second dye in a concentration effective to enhance the discharge rate of said sensitized zinc oxide at any given intensity of said radiation, said second dye being selected from the group consisting of Bromophenol Blue and Phloxine B;

imagewise exposing said charged electrophotographic printing element to near infrared radiation effecting charge dissipation of said element; and, toning the sheet with an electrostatic toner to produce a toned image.

26. The method of claim 25 additionally comprising a modifier effective in preventing cracking of said composition upon drying.

27. The method of claim 25 wherein said binder comprises an acrylic resin.

28. The method of claim 25 wherein said paper base sheet comprises conductive paper.

* * * * *